US010553064B2

(12) United States Patent
Bang et al.

(10) Patent No.: US 10,553,064 B2
(45) Date of Patent: Feb. 4, 2020

(54) MEDIUM STORAGE BOX, FINANCIAL DEVICE, AND METHOD OF CONTROLLING THE SAME

(71) Applicant: ATEC AP CO., LTD., Seongnam-si, Gyeonggi-do (KR)

(72) Inventors: Young Sik Bang, Seoul (KR); Young Seop Bae, Seoul (KR)

(73) Assignee: ATEC AP CO., LTD., Seongnam-si (KR)

( * ) Notice: Subject to any disclaimer, the term of this patent is extended or adjusted under 35 U.S.C. 154(b) by 51 days.

(21) Appl. No.: 15/622,405

(22) Filed: Jun. 14, 2017

(65) Prior Publication Data

US 2017/0365122 A1 Dec. 21, 2017

(30) Foreign Application Priority Data

Jun. 15, 2016 (KR) ..... 10-2016-0074394
Jun. 21, 2016 (KR) ..... 10-2016-0077101

(51) Int. Cl.
*G07D 11/235* (2019.01)

(52) U.S. Cl.
CPC ..... *G07D 11/235* (2019.01)

(58) Field of Classification Search
USPC ..... 235/379
See application file for complete search history.

(56) References Cited

U.S. PATENT DOCUMENTS 5,012,075 A * 4/1991 Hutchison ..... G07F 9/06 235/379
7,850,076 B1 * 12/2010 Dorenbaum ..... G07D 11/40 235/381
2004/0164147 A1 * 8/2004 Jenkins ..... G06Q 20/1085 235/382
2008/0087720 A1 * 4/2008 Levitov ..... G06Q 20/4014 235/379
2014/0263619 A1 9/2014 Turocy et al.
2015/0226773 A1 8/2015 Lee
2015/0364015 A1 12/2015 Turocy et al.

FOREIGN PATENT DOCUMENTS

JP 11213214 A 8/1999
JP 2000163631 A 6/2000
JP 2004355270 A 12/2004
KR 101528702 B1 6/2015
WO 2015/179854 A1 11/2015

* cited by examiner

*Primary Examiner* — Michael G Lee
*Assistant Examiner* — David Tardif
(74) *Attorney, Agent, or Firm* — Dentons US LLP

(57) ABSTRACT

A medium storage box according to an embodiment includes: a cassette body having a storage space in which a medium is stored; a cassette door coupled to the cassette body to open or close the storage space; a door opening detection unit for generating an open detection signal when the cassette door is opened; a microcomputer for determining that the cassette door is opened when receiving the open detection signal, and for storing the determined opening information of the cassette door in a cassette memory; and a battery for supplying power to the door detection unit and the microcomputer, wherein when the open detection signal is generated in the door opening detection unit, the battery supplies power to the microcomputer.

14 Claims, 16 Drawing Sheets

MEDIUM STORAGE BOX, FINANCIAL DEVICE, AND METHOD OF CONTROLLING THE SAME

CROSS-REFERENCE TO RELATED APPLICATIONS

The present application claims priority under 35 U.S.C. 119 and 35 U.S.C. 365 to Korean Patent Application No. 10-2016-0077101 (filed on Jun. 21, 2016) and 10-2016-0074394 (filed on Jun. 15, 2016), which is hereby incorporated by reference in its entirety.

BACKGROUND

The present disclosure relates to a medium storage box, a financial device, and a method of controlling the same.

Generally, a financial device provides desired financial services to customers. The financial device may deposit/withdraw a medium such as a bill, a check, a certificate of securities and a gift certificate, etc., or automatically transfer a medium.

The financial device may generally include a medium depositing and withdrawing unit for depositing or withdrawing a medium, and a medium storage cassette where the medium is stored. It is important that the medium storage cassette is designed to be capable of safely maintaining a security state against attack by an intruder in order to prevent loss of valuables such as bills, checks, securities, etc. stored therein.

A door locking device of a cassette is disclosed in Korean Patent No. 10-1114634.

According to the prior document, the door locking device of a cassette includes: a pinion which is rotated on an inner side surface of the door by a key operation of a bundle of keys installed on the door; a first locking means having a first hook installed on an inner side surface of the door and being ballast in a vertical direction when the door is closed to be held in a first engaging groove formed in a main body and a first movable member for moving the first hook in a direction in which the first hook is released from being held in the first engaging groove in accordance with rotation of the pinion by forming a first rack to be engaged with the pinion; and a second locking means having a second hook installed on an inner side surface of the door and being ballast in a vertical direction when the door is closed to be held in a second engaging groove formed in the main body and a second movable member for moving the second hook in a direction in which the second hook is released from being held in the second engaging groove in accordance with the rotation of the pinion by forming a second rack to be engaged with the pinion, wherein the first hook and the second hook are opposite to each other in a direction in which both hooks are held to the engaging grooves.

The prior document proposes a door locking device of a cassette in which a cassette door of an automatic teller machine (ATM) having an auto-lock function is prevented from being released by an impact.

However, in the prior document, a security of the cassette is locked and unlocked by key operation. Accordingly, even if an intruder uses the key to open the cassette to take out some or the entire medium inside the cassette, an administrator may have no way to verify that situation.

As an example, when a security company collects the medium storage cassette, even if the security company opens the cassette door for collecting cash and takes out some or the entire medium, or attempts to open the cassette door, an administrator have no way to verify that situation.

SUMMARY

The embodiment provides a medium storage box, a financial device, and a method of controlling the financial device in which the number of times of door openings of a medium storage box is recorded, and an administrator may confirm the same.

In addition, the embodiment also provides a medium storage box, a financial device, and a method of controlling the financial device, wherein the number of times of door openings of a medium storage box is recorded without connecting to an external device even when the medium storage box is carried on.

A medium storage box of the embodiment includes: a cassette body having a storage space in which a medium is stored; a cassette door coupled to the cassette body to open and close the storage space; a door opening detection unit for generating an open detection signal when the cassette door is opened; a microcomputer for determining that the cassette door is opened when receiving the open detection signal, and for storing the determined opening information of the cassette door in a cassette memory; and a battery for supplying power to the door opening detection unit and the microcomputer, wherein the battery supplies power to the microcomputer when the open detection signal is generated in the door opening detection unit.

In another aspect of the embodiment, a financial device includes: a body having a medium depositing and withdrawing unit for depositing and withdrawing a medium; a cassette supporter provided in the body; a medium storage box detachably mounted on the cassette supporter; and a main memory in which information for the medium storage box may be stored. Moreover, the medium storage box includes: a door opening detection unit for detecting that a cassette door of the medium storage box is opened; a cassette memory in which door opening information of the cassette door is stored; and a battery for supplying power to the medium storage box, wherein, the information stored in the cassette memory is transmitted to the main memory when the medium storage box is mounted.

In still another aspect of the embodiment, a method of controlling a financial device includes steps of: detecting, by a door opening detection unit, that a cassette door of a medium storage box is opened when the medium storage box is separated from a financial device; storing door opening information sensed by the door opening detection unit in a cassette memory; and transmitting medium storage box information stored in the cassette memory to the financial device when the medium storage box is mounted on the financial device.

DETAILED DESCRIPTION OF THE EMBODIMENTS

Figure 1:
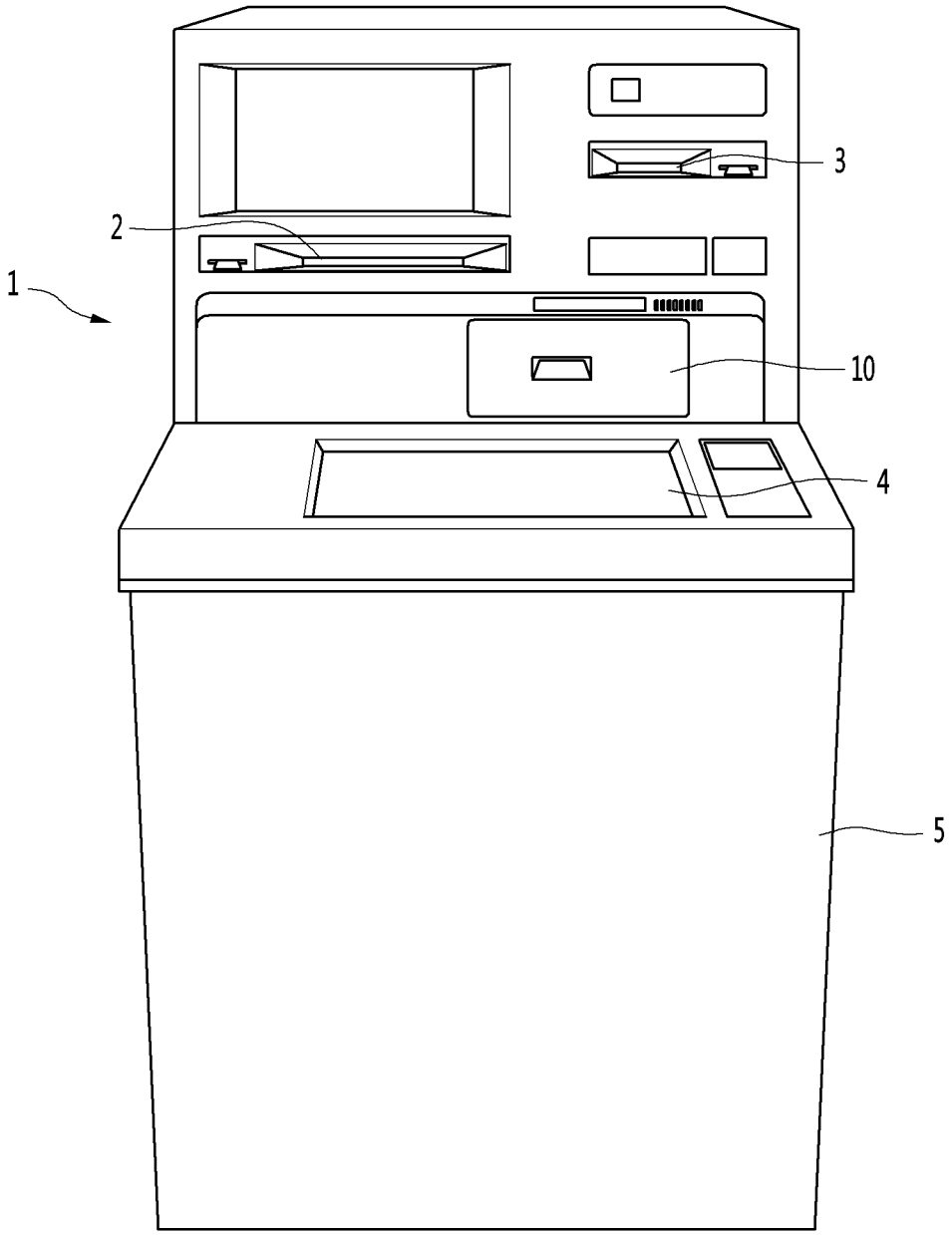
FIG. 1 is a perspective view of a financial device according to a first embodiment.

Hereinafter, exemplary embodiments of the present disclosure will be described with reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

A financial device according to embodiments is a device that performs financial businesses, i.e., medium processing including processing such as deposit processing, giro receipt, or gift certificate exchange and/or processing such as withdrawal processing, giro dispensing, or gift certificate dispensing by receiving various media such as, e.g., bills, bills, giros, coins, gift certificates, etc. For example, the financial device may comprise an automatic teller machine (ATM) such as a cash dispenser (CD) or a cash recycling device. However, the financial device is not limited to the above-described examples. For example, the financial device may be a device for automatically performing the financial businesses such as a financial information system (FIS).

Hereinafter, assuming that the financial device is the ATM, an embodiment will be described. However, this assumption is merely for convenience of description, and technical idea of the present disclosure is not limited to the ATM.

FIG. 1 is a perspective view of a financial device according to an embodiment.

Referring to FIG. 1, a financial device 1 according to the embodiment may include a body 5 having a plurality of parts therein. The body 5 may include a medium depositing and withdrawing unit 10 for depositing or withdrawing media.

The medium depositing and withdrawing unit 10 includes a medium storage space accessible by a customer, and the storage space may be opened or closed by a closure member such as a shutter or a cover, etc., and sometimes an open state may be maintained without being opened or closed.

In addition, the body 5 may include a medium processing device 6 for processing stacking, separation, transfer, and recognition for depositing and withdrawing a bill, a check or the like which is input or released inside the financial device 1.

The financial device 1 may further include a bankbook input/output unit 2 for inputting or outputting a bankbook, and a card input/output unit 3 for inputting or outputting a card. In addition, the financial device 1 may further include a user interface 4 that displays a menu and information for deposit or withdrawal, and receives a command or information for deposit or withdrawal. At this time, a user may be a customer or a manager of a financial device. As an example, the user interface 4 may display a menu and information for deposit or withdrawal, or display information of a counted medium. In addition, the user interface 4 may be provided in a form attached to a financial device.

In addition, the financial device 1 may further include an administrator apparatus (not shown) for managing a status and internal information of the financial device 1. The status and internal information of the financial device may be newly input or changed by the administrator apparatus.

Figure 2:
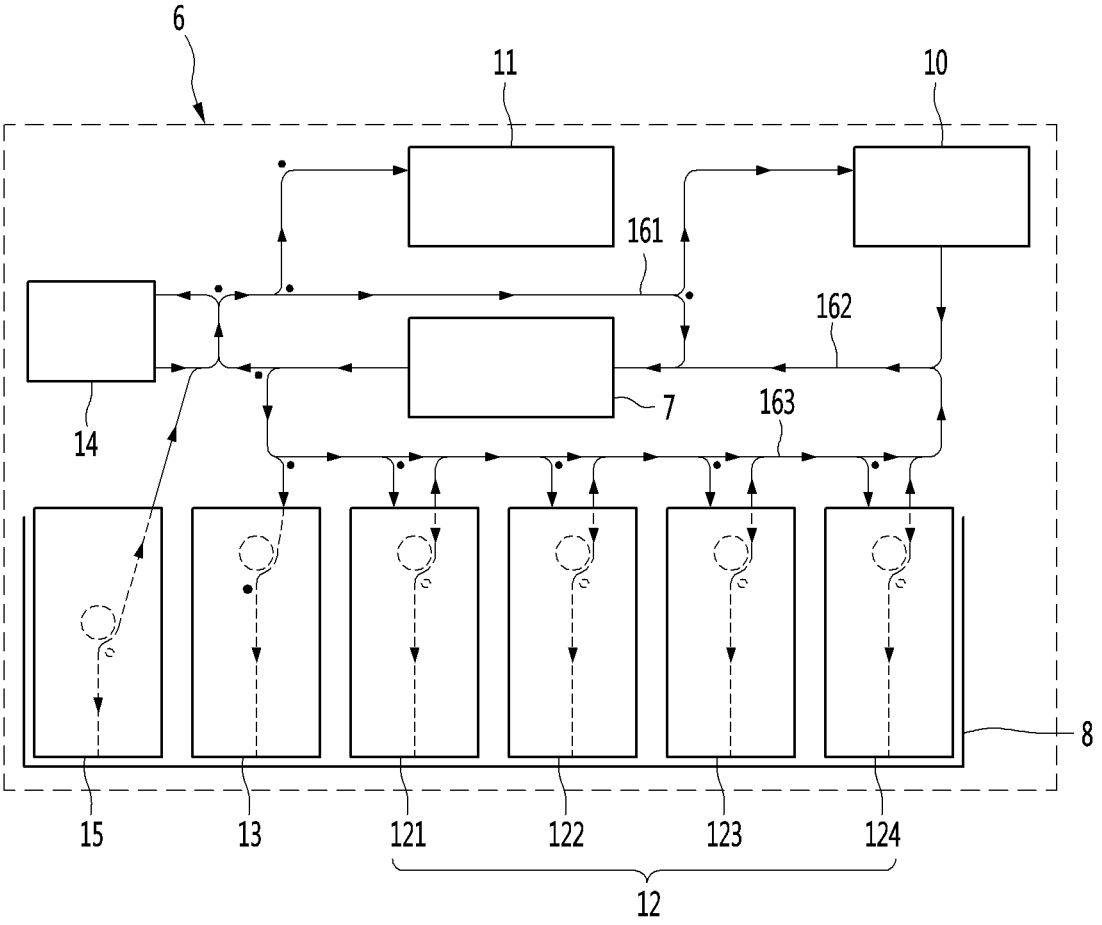
FIG. 2 is a configuration diagram of a medium processing device according to the first embodiment.

FIG. 2 is a configuration diagram of a medium processing device according to an embodiment.

Referring to FIG. 2, the medium processing device 6 may include the medium depositing and withdrawing unit 10 for depositing and withdrawing media. The medium depositing and withdrawing unit 10 may perform a common depositing/withdrawing function in which a plurality of types of medium may be deposited and withdrawn. Media in bundle unit including a single sheet may be input into the medium depositing and withdrawing unit 10. In addition, the medium depositing and withdrawing unit 10 may withdraw media in bundle unit.

The medium processing device 6 may further include a discrimination unit 7 for identifying a type and state of a medium. The discrimination unit 7 is capable of discriminating the kind of a medium of determining an abnormal medium when the medium is deposited or withdrawn. The defective medium may be an unrecognized medium by the discrimination unit 7. Alternatively, the defective medium may be in an externally deformed state due to a loss of a part of the medium. Alternatively, the defective medium may mean that a foreign substance is adhered to the surface of the medium, or that the medium contains a form other than drawings such as a letter, a picture, and the like.

The medium processing device 6 may further include a temporary stacking unit 11 in which a medium is temporarily stacked. When a customer desires to deposit a medium into the financial device 1, the temporary stacking unit 11 may temporarily store the medium which is deposited through the medium depositing and withdrawing unit 10. When the depositing of the medium is finally determined by the customer, the medium stacked in the temporary stacking unit 11 may be transferred to a medium storage cassette 12 which is to be described later.

The medium processing device 6 may further include a medium storage cassette 12 for storing a medium for deposit or withdrawal. The medium storage cassette 12 may include at least one bill cassette 121, 122, 123 in which a bill is stored. In addition, the medium storage cassette 12 may further include at least one check cassette 124 in which a check is stored. In this description, the number of the bill cassettes and the check cassettes is not limited. As another example, it is also possible for the medium storage cassette 12 to include only a bill cassette or a check cassette. Alternatively, the medium storage cassette 12 may further include a cassette for storing a gift certificate, a certificate of securities, a ticket, etc. Alternatively, the check cassette 124 may be replaced by a cassette that stores a gift certificate, a certificate of securities, a ticket, etc.

The medium processing device 6 may further include a first collecting cassette 13 in which a medium determined to be defective in a deposit process or rejected in a supplementary process is stored, a second collecting cassette 14 in which a medium determined to be defective in a withdrawal process is stored, and an operation cassette 15 for supplementing or collecting a medium.

The medium storage cassette 12, the first collecting cassette 13, the second collecting cassette 14, and the operation cassette 15 perform the function of stacking and storing a medium, thereby being named as a medium storage box 20.

In the embodiment, each of modules (a medium depositing and withdrawing unit, a discrimination unit, a medium storage cassette, a temporary stacking unit, a collecting cassette, etc.) configuring a financial device may be connected by a plurality of conveying paths 161, 162 and 163.

Figure 3:
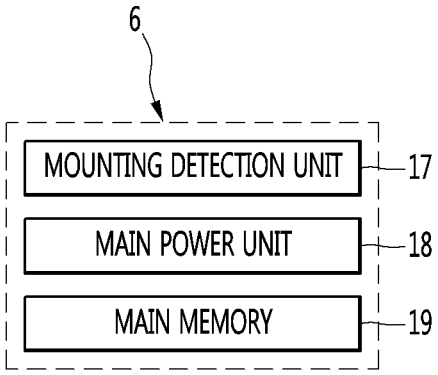
FIG. 3 is a block diagram schematically illustrating the medium processing device according to the first embodiment.

FIG. 3 is a block diagram briefly illustrating the medium processing apparatus according to the embodiment.

Referring to FIGS. 2 and 3, the medium processing apparatus 6 may further include a cassette supporter 8 for mounting one or more of the medium storage boxs 20.

The medium processing apparatus 6 may further include a mounting detection unit 17 for sensing that one or more of the medium storage boxs 20 are mounted on the cassette supporter 8. The mounting detection unit 17 may be provided in the cassette supporter 8.

A main power unit 18, which is to be described later, may supply power to the medium storage box 20 mounted on the cassette supporter 8, when the mounting detection unit 17 detects that the medium storage box 20 is mounted on the cassette supporter 8.

The medium processing apparatus 6 may further include the main power unit 18 for supplying power to the medium storage box 20 mounted on the cassette supporter 8. The main power unit 18 may supply power for operating the financial device 1. In addition, the main power unit 18 may supply power for driving the medium storage box 20 mounted on the financial device 1. In addition, the main power unit 18 may supply power for charging an internal power source (one example, a battery) of the medium storage box 20 mounted on the financial device 1.

In addition, the medium processing apparatus 6 may further include a main memory 19 in which medium storage box information of the medium storage box 20 mounted on the cassette supporter 8 may be stored. When the medium storage box 20 is mounted on the financial device 1, the medium storage box information stored in the medium storage box 20 may be transmitted to the financial device 1.

Meanwhile, the medium storage box information may include at least one of information such as, whether a cassette door 22 of the medium storage box mounted on the cassette supporter 8 is open or closed, the number of times of opening the cassette door 22, and a period of time when the cassette door 22 is open.

The medium storage box information may be displayed on the user interface 4. Therefore, an administrator may check the medium storage box information stored in the main memory 19. Alternatively, the medium storage box information stored in the main memory 19 may be displayed in another administrator apparatus.

Figure 4:
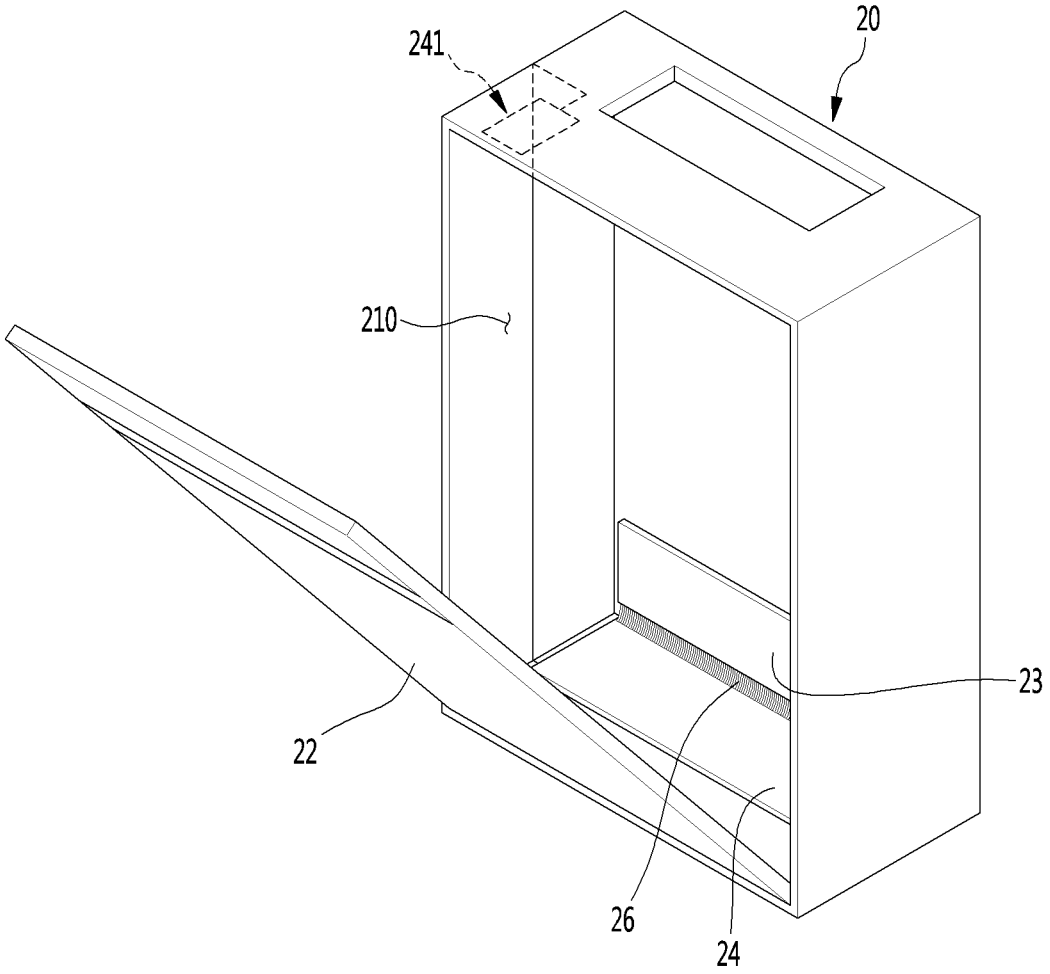
FIG. 4 is a perspective view schematically illustrating a media storage box according to the first embodiment.

FIG. 4 is a perspective view schematically illustrating a medium storage box according to the embodiment.

Referring to FIG. 4, the medium storage box 20 may include a cassette body 21 having a storage space 210. In the storage space 210, a medium may be stored.

The medium storage box 20 may include the cassette door 22 that is coupled to the cassette body 21. The cassette body 21 may be opened and closed by the cassette door 22.

The cassette door 22 may include a locking unit (not shown) provided for locking and releasing the locking. In addition, the cassette door 22 may further include an operation unit (not shown) operated to release the locking unit (not shown).

The medium storage box 20 may further include a main board 23 connected to the financial device 1. The main board 23 may sense that the medium storage box 20 is mounted on the financial device 1. Meanwhile, the main board 23 may be connected to the financial device 1 to receive power therefrom. The main board 23 may be disposed outside or inside the medium storage box 20. When the main board 23 is disposed outside the medium storage box 20, the configuration of receiving the power from the financial device 1 may be simplified by detecting that the medium storage box 20 is mounted on the financial device 1.

The medium storage box 20 may further include a sub-board 24 for storing the medium storage box information. The sub-board 24 may be disposed inside the medium storage box 20. Accordingly, it may be difficult to arbitrarily change or delete the medium storage box information stored in the sub-board 24 before an intruder opens the cassette door 22, thereby having an advantage that the medium storage box information stored in the sub-board 24 may be protected from the intruder.

The medium storage box 20 may further include connection means 26 for connecting the main board 23 and the sub-board 24 to each other to exchange information. As an example, when the medium storage box 20 is connected to the financial device 1, the main board 23 may transmit information to the sub-board 24 on which the medium storage box 20 is mounted on the financial device 1 by the connection means 26. The connection means 26 may be a wired communication means connected by wires to exchange information. Alternatively, the connection means 26 may be a wireless communication means capable of exchanging information through a separate wireless module. As an example, the wireless communication means may include a communication module such as a near field communication (NFC), an infrared data association (IrDA), a Bluetooth, and a ZigBee.

The medium storage box 20 may further include a door opening detection unit 241 for generating an open detection signal when the cassette door 22 is opened. As an example, the door opening detection unit 241 may include at least one of detection sensors such as an infrared sensor, a photo sensor, a hall sensor, a micro switch, and an ultrasonic sensor, etc.

According to the FIG. 4, the door opening detection unit 241 is disposed on an upper portion of the cassette body 21 to detect the opening of the cassette door 22. But, the door opening detection unit 241 may also be disposed inside the cassette body 21 to detect the opening of the cassette door 22.

Figure 5:
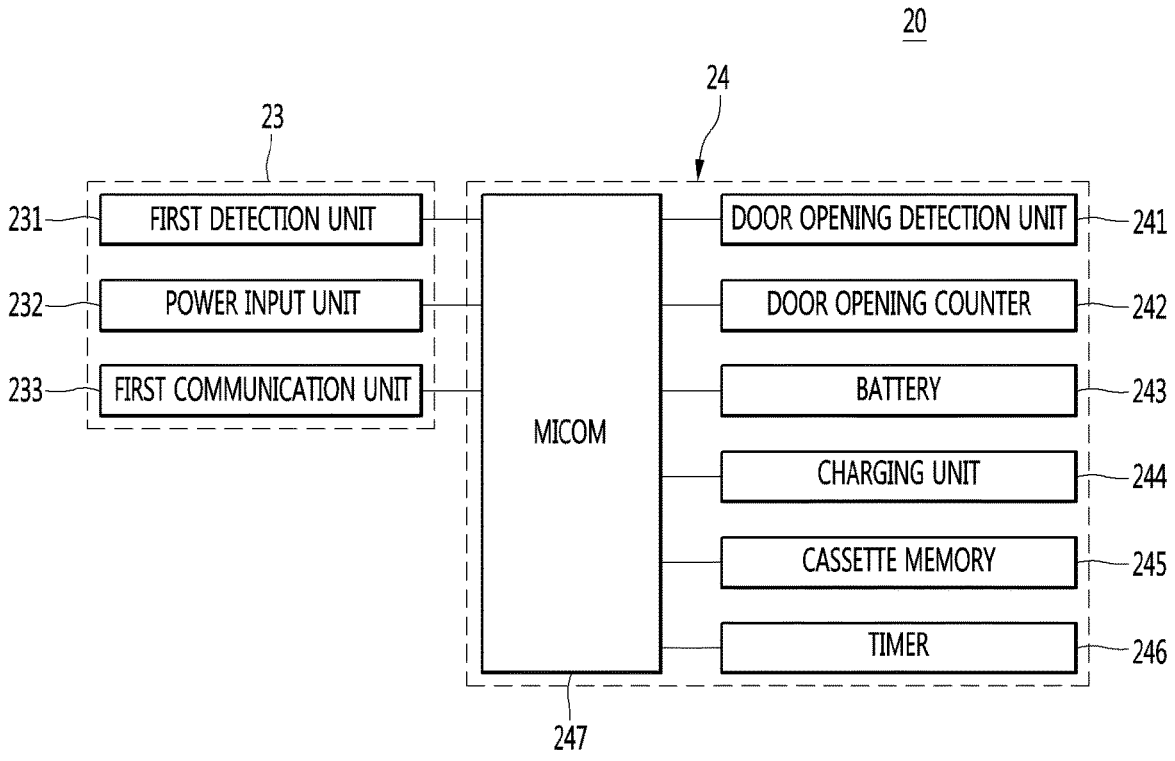
FIG. 5 is a block diagram of the medium storage box according to the first embodiment.

FIG. 5 is a block diagram of the medium storage box according to the embodiment.

Referring to FIG. 5, the main board 23 of the medium storage box 20 may include a first detection unit 231 for detecting that the medium storage box 20 is mounted on the cassette supporter 8.

The main board 23 may further include a power input unit 232 connected to the main power unit 18. The power input unit 232 is connected to the main power unit 18 so that the medium storage box 20 may receive power from the financial device 1. The power input unit 232 may include a power conversion circuit (not shown) for converting a voltage applied from the financial device 1 and transmitting the converted voltage to the sub-board 24. The voltage applied from the financial device 1 by the power conversion circuit may be converted into a driving voltage Vdd for driving the medium storage box 20. The converted driving voltage Vdd may be applied to the sub-board 24.

The main board 23 may further include a first communication unit 233 capable of transmitting and receiving information to and from the financial device 1. When the medium storage box 20 is mounted on the financial device 1, the medium storage box information stored in the sub-board 24 may be transmitted to the main memory 19 of the financial device 1 by the first communication unit 233. The medium storage box information may include at least one of information such as, whether the cassette door 22 of the medium storage box mounted on the cassette supporter 8 is open or closed, the number of times of opening the cassette door 22, and a period of time when the cassette door 22 is open.

The first communication unit 233 may use wired communication connected to the financial device 1 using wires to exchange information. Alternatively, the first communication unit 233 may use wireless communication connected to the financial device 1 using a separate wireless module to exchange information.

The medium storage box 20 may include the door opening detection unit 241. When the medium storage box 20 is mounted on the financial device 1, the door opening detection unit 241 may receive power from the financial device 1. In addition, when the medium storage box 20 is unmounted from the financial device 1, the door opening detection unit 241 may receive power from a battery 243 provided in the medium storage box 20. Therefore, even when the medium storage box 20 is unmounted from the financial device 1, the door opening detection unit 241 may transmit door opening information indicating that the cassette door 22 is opened to a microcomputer 247.

The sub-board 24 may further include a door opening counter 242 for counting the opening of the cassette door 22. Whenever the cassette door 22 is opened, the door opening detection unit 241 may detect that the cassette door 22 is opened. And the door opening counter 242 may count the number of times the cassette door 22 is opened. In detail, door opening information indicating that the cassette door 22 is opened may be stored in a cassette memory 245. At this time, the door opening counter 242 may count the number of times the cassette door 22 is opened by referring to the door opening information stored in the cassette memory 245. The number of times counted by the door opening counter 242 may be stored in the cassette memory 245.

The sub-board 24 may further include the battery 243 capable of supplying another power to the medium storage box 20. When the medium storage box 20 is unmounted from the financial device 1, the battery 243 may supply power to the medium storage box 20. In detail, when the medium storage box 20 is unmounted from the financial device 1, the power supplied from the financial device 1 is cut off. Moreover, the medium storage box 20 may receive power from the battery 243. The battery 243 may be provided in, as an example, a rechargeable secondary battery.

The sub-board 24 may further include a charging unit 244 capable of charging the battery 243. When the medium storage box 20 is mounted on the financial device 1, the power input unit 232 may be connected to the main power unit 18 to supply power to the medium storage box 20. At this time, the charging unit 244 may operate so that the power of the main power unit 18 charges the battery 243. When the medium storage box 20 is unmounted from the financial device 1, the charging of the battery 243 by the charging unit 244 may be stopped.

Meanwhile, the sub-board 24 may be provided with a power driving circuit 25 for controlling power supplied to the medium storage box 20.

Figure 6:
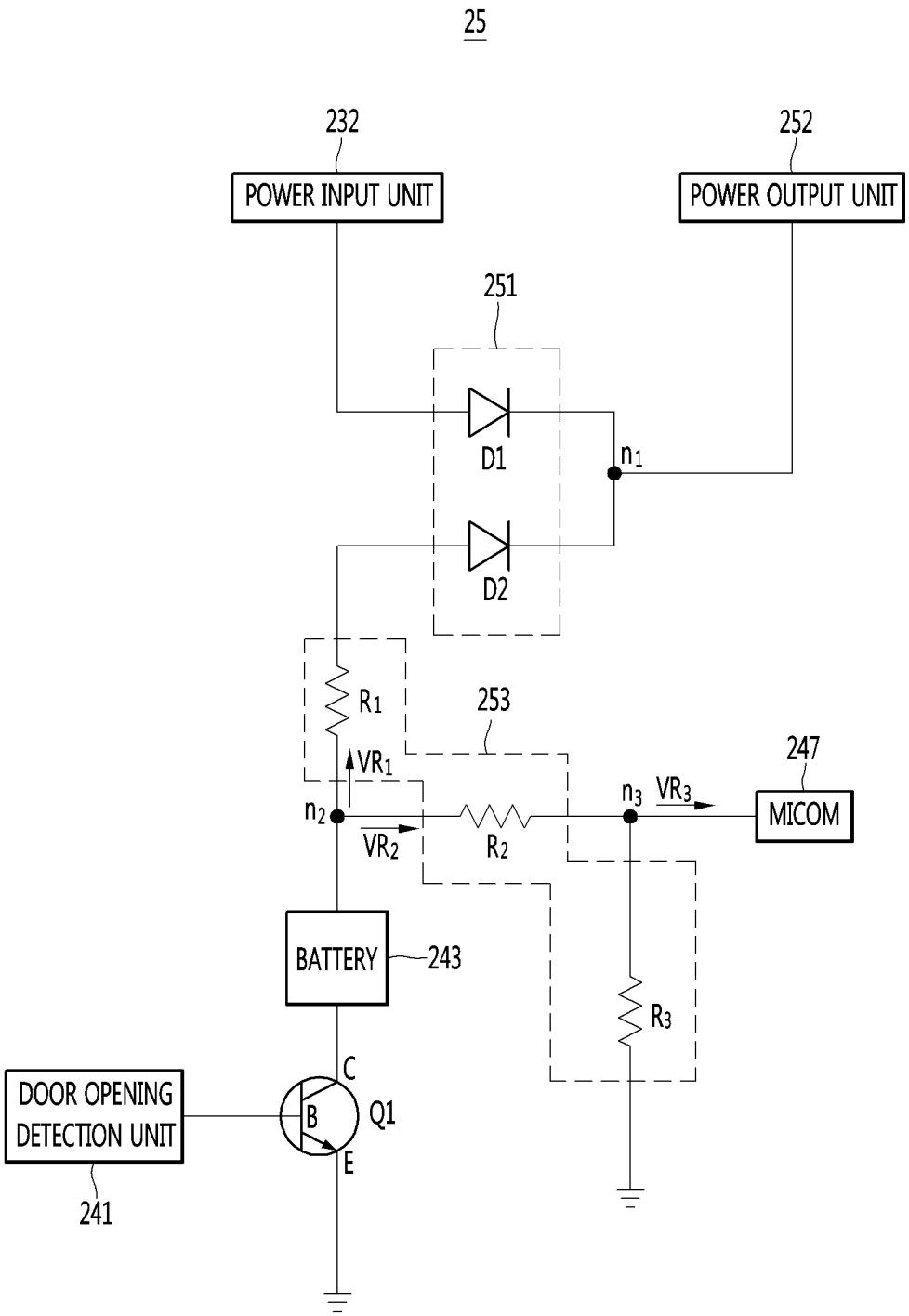
FIG. 6 is a circuit configuration diagram schematically illustrating a power driving circuit according to the first embodiment.

FIG. 6 is a circuit configuration diagram schematically illustrating a power driving circuit according to the embodiment.

Referring to FIG. 6, the power driving circuit 25 may include a power source selection unit 251 for selecting one between the power input unit 232 and the battery 243 to supply power to the medium storage box 20.

The power source selection unit 251 may include a first diode D1 and a second diode D2. An input terminal of the first diode D1 may be connected to the power input unit 232. Moreover, an output terminal of the first diode D1 may be connected to a first node n1. An input terminal of the second diode D2 may be connected to the battery 243. Moreover, an output terminal of the second diode D2 may be connected to the first node n1. Therefore, the power source selection unit 251 may select a power unit having a higher voltage among the power input unit 232 and the battery 243, and may supply power of the selected power unit to the medium storage box 20.

Meanwhile, the input terminals of the first and second diodes D1 and D2 may denote anode terminals of the first and second diodes D1 and D2. Further, the output terminals of the first and second diodes D1 and D2 may denote cathode terminals of the first and second diodes D1 and D2.

In the embodiment, a first voltage applied to the power input unit 232 from the main power unit 18 of the financial device is higher than a second voltage of the battery 243.

When the medium storage box 20 is mounted on the financial device 1, the power input unit 232 is connected to the main power unit 18 of the financial device 1. And, since the first voltage applied to the power input unit 232 from the main power unit 18 of the financial device 1 is larger than the second voltage of the battery 243, the medium storage box 20 may receive the voltage of the main power unit 18 through the power input unit 232.

On the contrary, when the medium storage box 20 is unmounted from the financial device 1, no power is applied to the power input unit 232. Therefore, the medium storage box 20 may receive only the power of the battery 243 by the power source selection unit 251.

The power source selection unit 251 may select the power supply between the power input unit 232 and the battery 243, but the power source selection unit 251 may also function to prevent the power supplied to the medium storage box 20 from flowing back into the power input unit 232 or from flowing back into the battery 243.

The power driving circuit 25 may further include a power output unit 252 connected to the first node n1. The power output unit 252 may output power selected from the power source selection unit 251. The power output from the power output unit 252 may be supplied to the sub-board 24. In addition, the power output from the power output unit 252 may be supplied to the door opening detection unit 241, which is to be described later.

The power driving circuit 25 may further include a voltage distribution unit 253 for distributing the voltage of the battery 243. The voltage distribution unit 253 may include a first resistor R1, a second resistor R2, and a third resistor R3. The first resistor R1 and the second resistor R2 may be connected in parallel so that the power of the battery 243 may be primarily distributed. A primarily distributed first voltage VR1 of the battery 243 may be input to the power source selection unit 251. Meanwhile, the second resistor R2 and the third resistor R3 are connected in parallel so that a primarily distributed second voltage VR2 of the battery 243 may be secondarily distributed. The secondarily distributed voltage may be transmitted to the microcomputer 247. Meanwhile, the voltage distribution unit 253 distributes the voltage of the battery 243 to supply a voltage according to the standard of the sub-board 24.

The power driving circuit 25 may further include a transistor Q0 for amplifying an input signal and transmitting the amplified signal to an output terminal. The battery 243 and the door opening detection unit 241 may be connected to the transistor Q0. In detail, the transistor Q0 may include a collector terminal C, a base terminal B, and an emitter terminal E. The input terminal of the battery 243 may be connected to the collector terminal C of the transistor Q0. In addition, the door opening detection unit 241 may be connected to the base terminal B of the transistor Q0. In addition, a low voltage line may be connected to the emitter terminal E of the transistor Q0. The low voltage line may be understood as ground.

The transistor Q0 may transmit an open signal of the cassette door 22 to the microcomputer 247 by a switch operation. In detail, when the cassette door 22 is opened, an open signal having a logic high voltage may be input to the base terminal B of the transistor Q0. At this time, the transistor Q0 may be turned on by the open signal. Moreover, the collector terminal C and the emitter terminal E of the transistor Q0 may be connected to each other by the open signal. Accordingly, the power driving circuit 25 may be provided with a closed circuit through which the battery 243 may be discharged. The power of the battery 243 may be supplied to the microcomputer 247 and the power source selection unit 251. At this time, when the power of the battery 243 is supplied to the microcomputer 247, the microcomputer 247 recognizes that the cassette door 22 is opened. In other words, when the power of the battery 243 is supplied to the microcomputer 247, the microcomputer 247 may recognize the supplied power of the battery 243 as an open signal.

As another example, when the cassette door 22 is opened, an open signal from the door opening detection unit 241 may be input to the base terminal B. In addition, the open signal may be amplified by the transistor Q0 and transmitted to the battery 243. The input signal level of the door opening detection unit 241 may be amplified by the transistor Q0. Although the signal level input to the door opening detection unit 241 is small, the microcomputer 247 may detect more accurately the opening of the cassette door 22.

Meanwhile, the transistor Q0 may desirably denote a bipolar junction transistor (BJT). However, in addition to the bipolar junction transistor, a metal oxide silicon field effect transistor (MOSFET) and a junction field effect transistor (JFET) may be applied to the transistor Q0.

Referring again to FIG. 5, the sub-board 24 may further include the cassette memory 245 in which the medium storage box information may be stored. The medium storage box information may include at least one of information such as, whether the cassette door 22 is opened, the number of times of opening the cassette door 22, and the period of time when the cassette door 22 is open. As an example, during transport for collecting a medium of the medium storage box 20, when the cassette door 22 is open, the number of times the cassette door 22 is open may be counted, and the counted information may be stored in the cassette memory 245.

The cassette memory 245 may include a non-volatile memory. Therefore, even if the power supplied to the cassette memory 245 is shut off, the information stored therein may be maintained.

The sub-board 24 may further include a timer 246 that may count the date and time. The timer 246 may continuously receive power from the battery 243 regardless of whether the cassette door 22 is opened or closed. Thus, the date and time at which the medium storage box 20 is mounted on or unmounted from the financial device 1 may be stored in the cassette memory 245. Also, the date and time when the cassette door 22 is opened may be stored in the cassette memory 245.

Accordingly, an administrator may confirm the time and date when the cassette door 22 is opened, and the time and date when the medium storage box 20 is mounted on or unmounted from the financial device 1, thereby confirming whether or not a medium of the medium storage box 20 is taken out. In addition, there is an advantage that the administrator is able to confirm the taken-out time and date when a medium of the medium storage box 20 is taken out.

The medium storage box 20 may further include the microcomputer 247 for controlling the main board 23 and the sub-board 24. The microcomputer 247 may be desirably disposed on the sub-board 24. Therefore, the main board 23 is connected to the microcomputer 247 by the connection means 26, so that the main board 23 may transmit the information of the main board 23 to the microcomputer 247. Based on the information of the main board 23, the microcomputer 247 may control the sub-board 24, that is, one of the door opening detection unit 241, the door opening counter 242, the battery 243, the charging unit 244, the cassette memory 245, and the timer 246.

In addition, the microcomputer 247 may transmit the information stored in the cassette memory 245 to the financial device 1 when the medium storage box 20 is mounted on the financial device 1.

Hereinafter, a control method of the financial device 1 will be described, wherein the financial device 1 is controlled according to the opening of the cassette door 22.

Figure 7:
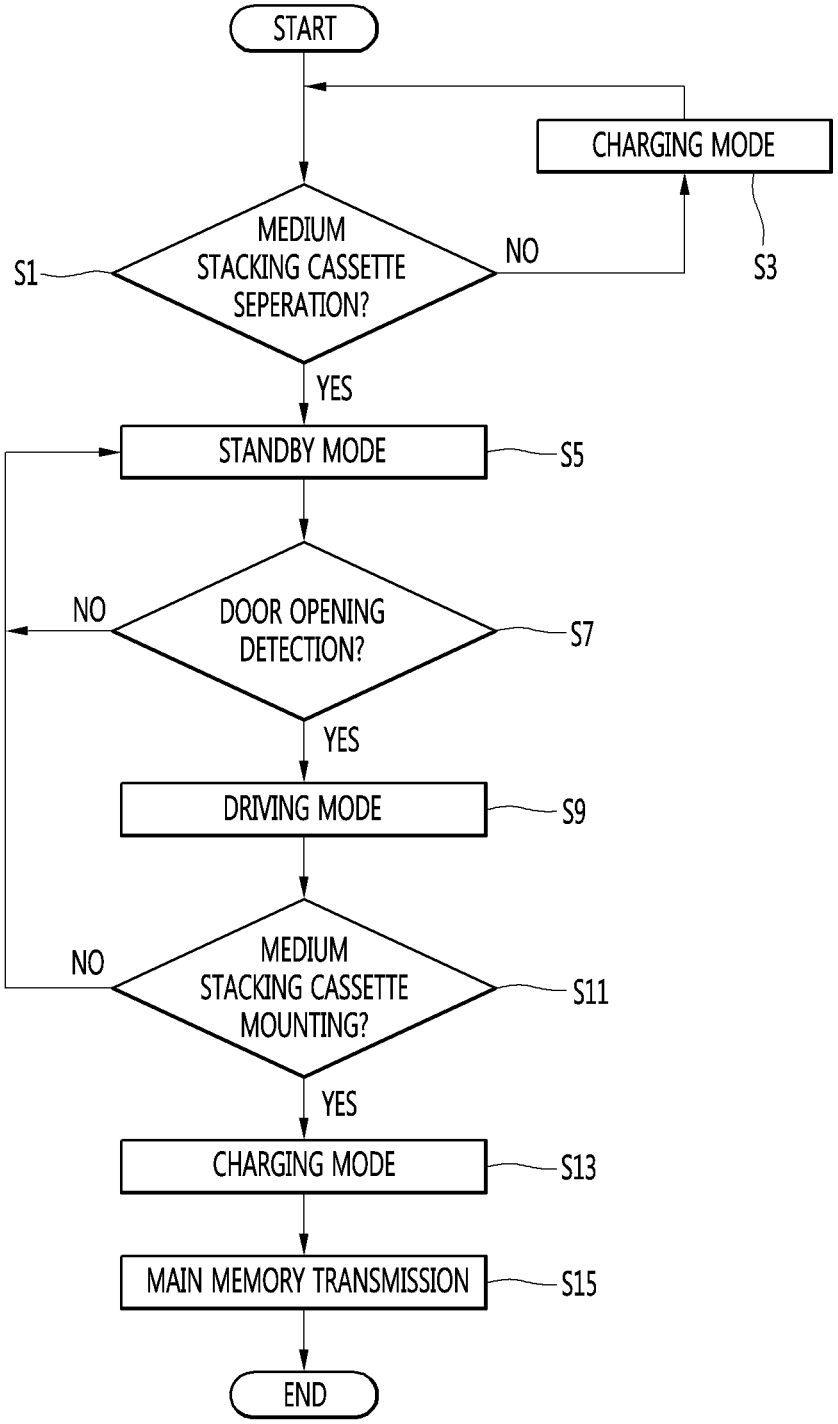
FIG. 7 is a flowchart illustrating the operation of the medium storage box according to the first embodiment.

FIG. 7 is a flowchart illustrating the operation of the medium storage box according to the embodiment.

Referring to FIGS. 6 and 7, the medium storage box 20 may be unmounted from the financial device 1 in step S1. As an example, if the media storage number that may be stored in the medium storage box 20 is exceeded, the medium storage box 20 may be unmounted from the financial device 1. Alternatively, the medium storage box 20 may be unmounted from the financial device 1 in order to supplement the medium to the medium storage box 20.

The microcomputer 247 may operate in a charging mode in a state where the medium storage box 20 is mounted on the financial device 1 in step S3. When the first detection unit 231 detect that the medium storage box 20 is mounted on the cassette supporter 8, the main power unit 18 of the financial device 1 may be connected to the power input unit 232 of the medium storage box 20. The main power unit 18 is connected to the power input unit 232 so that the power of the financial device 1 may be supplied to the medium storage box 20.

The power supplied to the power input unit 232 may be selected by the power source selection unit 251 and transmitted to the power output unit 252 connected to the first node n1. As an example, when the medium storage box 20 is mounted on the financial device 1, the power input unit 232 is connected to the main power unit 18. The first voltage of the main power unit 18 of the financial device 1 is higher than the second voltage of the battery 243, wherein the first voltage is supplied to the power input unit 232. Accordingly, the medium storage box 20 may receive the power of the power input unit 232 by the power source selection unit 251. At this time, the microcomputer 247 may control the voltage of the power input unit 232 to be supplied to the battery 243 through the charging unit 244. Therefore, the battery 243 is charged.

When the microcomputer 247 operates in the charging mode, the consumed power of the battery 243 is charged. Accordingly, even if the medium storage box 20 is separated from the financial device 1 later, the medium storage box 20 may be stably operated.

In a state where the medium storage box 20 is unmounted from the financial device 1, the microcomputer 247 may operate in a standby mode in step S5. The standby mode may mean that the power of the battery 243 is not connected to the microcomputer 247 and the cassette memory 245. That is, if a signal is not inputted to the base terminal B of the transistor Q0 due to a characteristic of the transistor Q0, the collector terminal C may not be connected to the ground. Therefore, since the power of the battery 243 may not be transmitted to the microcomputer 247 of the sub-board 24, the power consumption of the battery 243 may be minimized.

The microcomputer 247 may maintain the standby mode until detecting that the cassette door 22 is opened in steps S5 and S7.

When the door opening detection unit 241 detects that the cassette door 22 is opened in step S7, the microcomputer 247 may be operated in a driving mode in step S9. The door opening detection unit 241 may receive power from the battery 243. Accordingly, the door opening detection unit 241 may detect that the cassette door 22 is opened.

The door opening detection unit 241 may detect that the cassette door 22 is opened. At this time, an open detection signal may be input to the base terminal B of the transistor Q0. The open detection signal may be, for example, an open signal having a logic high voltage.

When the open signal is inputted to the base terminal B of the transistor Q0, the collector terminal C and the emitter terminal E of the transistor Q0 may be shorted to each other. Moreover, the collector terminal C and the emitter terminal E of the transistor Q0 are connected to each other. Accordingly, the power driving circuit 25 may be provided with a closed circuit for supplying power from the battery 243. Therefore, the power of the battery 243 may be transmitted to the microcomputer 247. When the power of the battery 243 is supplied to the microcomputer 247, the microcomputer 247 may recognize that the cassette door 22 is opened. In other words, when the power of the battery 243 is supplied to the microcomputer 247, the microcomputer 247 may recognize the supplied power of the battery 243 as an open signal.

The microcomputer 247 may store the opening of the cassette door 22 in the cassette memory 245. In addition, the microcomputer 247 refers to whether the cassette door 22 is open or not, which is stored in the cassette memory 245, and the number of times the cassette door 22 is opened may be stored in the cassette memory 245.

As an example, when the cassette door 22 is opened, the microcomputer 247 may receive the open signal by the door opening detection unit 241. The microcomputer 247 may store the information that the cassette door 22 is opened in the cassette memory 245. And, the door opening counter 242 may count the number of times the cassette door 22 is opened.

The number of times the cassette door 22 is opened may be stored in the cassette memory 245 by the door opening counter 242. Further, the time at which the cassette door 22 is opened may be counted by the timer 246, and the counted time may be stored in the cassette memory 245.

When the cassette door 22 is closed, the microcomputer 247 may be switched to the standby mode. The power supplied to the microcomputer 247 and the cassette memory 245 may be shut off again when the microcomputer 247 is switched to the standby mode.

Since the microcomputer 247 is in the standby mode until the cassette door 22 is opened, the power of the battery 243 may be efficiently utilized. Furthermore, discharge of the battery 243 may be minimized even when the medium storage box 20 is transported for a long time.

The microcomputer 247 may be operated in the charging mode in step S13 when the medium storage box 20 is mounted on the financial device 1 in step S13. By charging the battery, it is possible to stably count the opening of the cassette door 22 even if the medium storage box 20 is unmounted from the financial device 1. The microcomputer 247 is capable of storing the counted information in the cassette memory 245. At least one of the information on which the cassette door 22 is opened and the counted number of times may be stored in the cassette memory 245 as medium storage box information.

The microcomputer 247 may transmit the medium storage box information stored in the cassette memory 245 to the main memory 19 in step S15 when the medium storage box 20 is mounted on the financial device 1 in step S13. The microcomputer 247 may transmit the medium storage box information stored in the cassette memory 245 to the main memory 19 via the first communication unit 233. The medium storage box information transmitted to the main memory 19 may be displayed on the user interface 4 or displayed on another administrator apparatus. Therefore, when the medium storage box 20 is mounted on the financial device 1, an administrator may confirm whether or not a medium is taken out of the medium storage box 20 using the medium storage box information. As an example, when an intruder takes out a medium forcibly from a medium storage box in transit, the administrator may confirm that the medium has been taken out from the medium storage box and may determine that the medium has been taken out from the intruder. In addition, there is an advantage that the administrator is able to confirm the taken-out time using the information when the cassette door 22 is opened.

Hereinafter, another embodiment will be described.

In the embodiment, the same parts as those of the prior embodiment are omitted, and the differences are mainly described.

Figure 8:
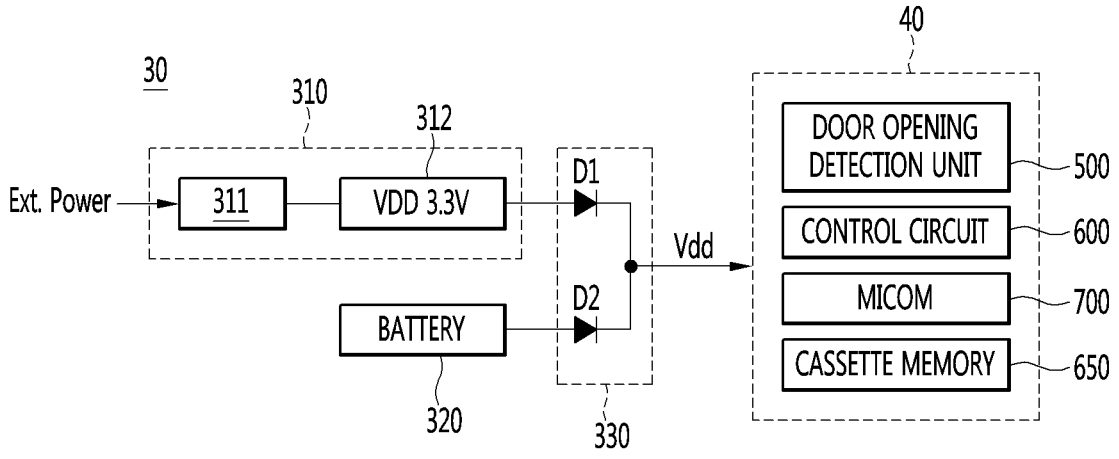
FIG. 8 is a configuration diagram of an example of a power driving circuit for supplying power from the medium storage box to a sub-board according to a second embodiment.

FIG. 8 is a configuration diagram of an example of a power driving circuit for supplying power from the medium storage box to a sub-board according to a second embodiment.

Referring to FIG. 8, the financial device 1 may include a medium storage box 20 for stacking and storing a medium. The medium storage box 20 may include a sub-board 40 that detects the opening of the cassette door 22 and stores medium storage box information.

In addition, the medium storage box 20 may further include a power driving circuit 30 for supplying power to the sub-board 40.

The power driving circuit 30 may be provided in the medium storage box 20 and may include a battery 320 for supplying a driving voltage Vdd to the sub-board 40.

The power driving circuit 30 may further include a power input unit 310 for converting external power supplied from the financial device 1 into a driving voltage and supplying the driving voltage to the sub-board 40.

The power input unit 310 may include a power line connection terminal 311 that is connected to the financial device 1 and receives power from the financial device 1. In addition, the power input unit 310 may further include a power conversion circuit 312 that converts the power of the financial device 1 to the driving voltage Vdd, wherein the power is inputted through the power line connection terminal 311. The power conversion circuit 312, as an example, may convert the voltage of the power source supplied from the financial device 1 to a driving voltage Vdd of 3.3 V. The driving voltage Vdd converted by the power conversion circuit 312 may be transmitted to the sub-board 40.

The power driving circuit 30 may further include a power source selection unit 330 for supplying the sub-board 40 with power by selecting either the power source of the battery 320 or the power source of the financial device 1 supplied through the power input unit 310. The power source selection unit 330 may include a first diode D1 and a second diode D2. The power input unit 310 and the battery 320 may be connected to the first and second diodes D1 and D2, respectively. The power source selection unit 330 may select a power unit having a higher voltage among the power input unit 310 and the battery 320, and may supply power of the selected power unit to the medium storage box 20.

Figure 9:
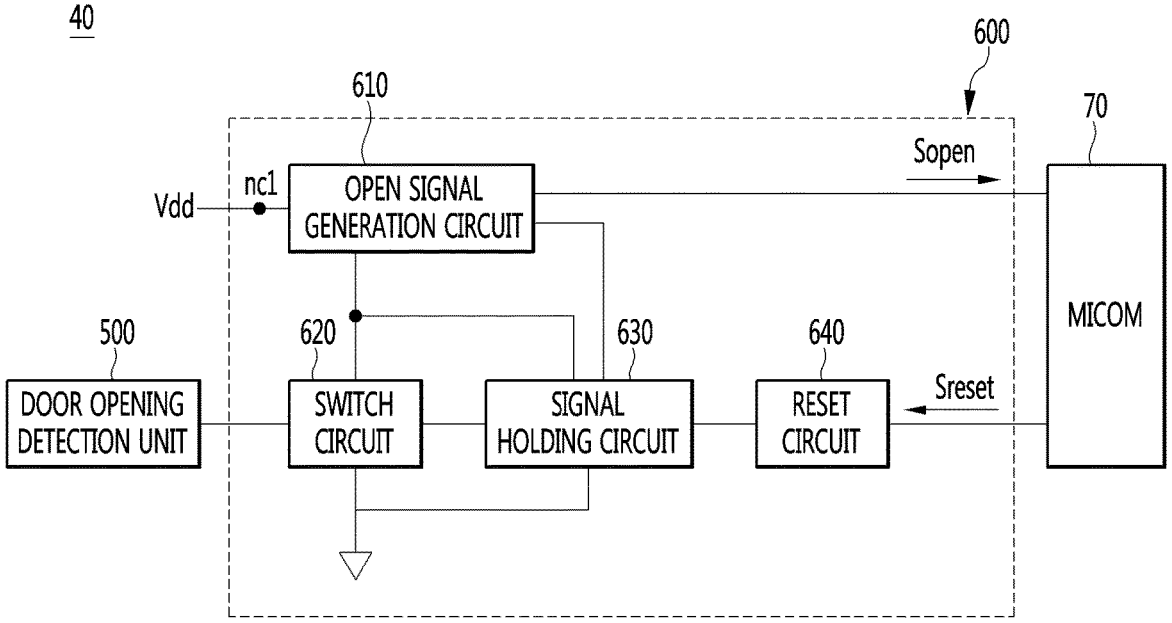
FIG. 9 is a configuration diagram of the sub-board according to the second embodiment.

FIG. 9 is a configuration diagram of the sub-board according to the second embodiment.

Referring to FIG. 9, a control circuit 600 of the door opening detection unit 500 may include an open signal generation circuit 610 for generating an open signal Sopen. When the cassette door 22 is opened, the open signal generation circuit 610 may generate an open signal Sopen. One side of the open signal generation circuit 610 is connected to a control circuit first node nc1. Further, the open signal generation circuit 610 may receive a driving voltage Vdd through the control circuit first node nc1. The driving voltage Vdd may be any one of the voltage of the financial device 1 and the voltage of the battery 320 selected by the power source selection unit 330.

Another side of the open signal generation circuit 610 may be connected to a microcomputer 70. The open signal Sopen may be transmitted to the microcomputer 70 through the other side of the open signal generation circuit 610. When the open signal Sopen is transmitted to the microcomputer 70, the microcomputer 70 may store information (or open information) in which the cassette door 22 is opened in a cassette memory 650 provided in the sub-board 40. Moreover, when the medium storage box 20 is mounted on the financial device 1, the information stored in the cassette memory 650 may be transmitted to the financial device 1. In another embodiment, the microcomputer 70 may have a function of a storage medium so as to store the opening information of the cassette door 22.

Meanwhile, still another side of the open signal generation circuit 610 may be connected to a control circuit second node nc2. The control circuit second node nc2 may be connected to a switch circuit 620 operated on the basis of opening or closing of the cassette door 22. The switch circuit 620 will be described later.

Meanwhile, the open signal generation circuit 610 may generate the open signal Sopen by recognizing an electrical state change (for example, a voltage change) formed in the control circuit second node nc2. The electrical state of the control circuit second node nc2 may be determined by the switch circuit (620).

The control circuit 600 may further include the switch circuit 620. The switch circuit 620 may be connected to the door opening detection unit 500. Then, based on whether the cassette door 22 is opened or closed, the switch circuit 620 may be turned on or off. In detail, the switch circuit 620 may include at least one switch connected to the door opening detection unit 500. The switch SW may be opened or closed by the door opening detection unit 500. The switch circuit 620 may be turned on or off according to the open or closed state of the switch SW.

One side of the switch circuit 620 may be connected to the low voltage line. The other side of the switch circuit 620 may be connected to the control circuit second node nc2. The switch circuit 620 may form the voltage of the control circuit second node nc2 to be low or high based on the opening or closing of the cassette door 22. For example, the switch circuit 620 may form the voltage of the control circuit second node nc2 to be low near the voltage of the low voltage line, depending on the opening or closing of the cassette door 22. In addition, the switch circuit 620 may separate the voltage of the control circuit second node nc2 from the low voltage line.

Figure 10:
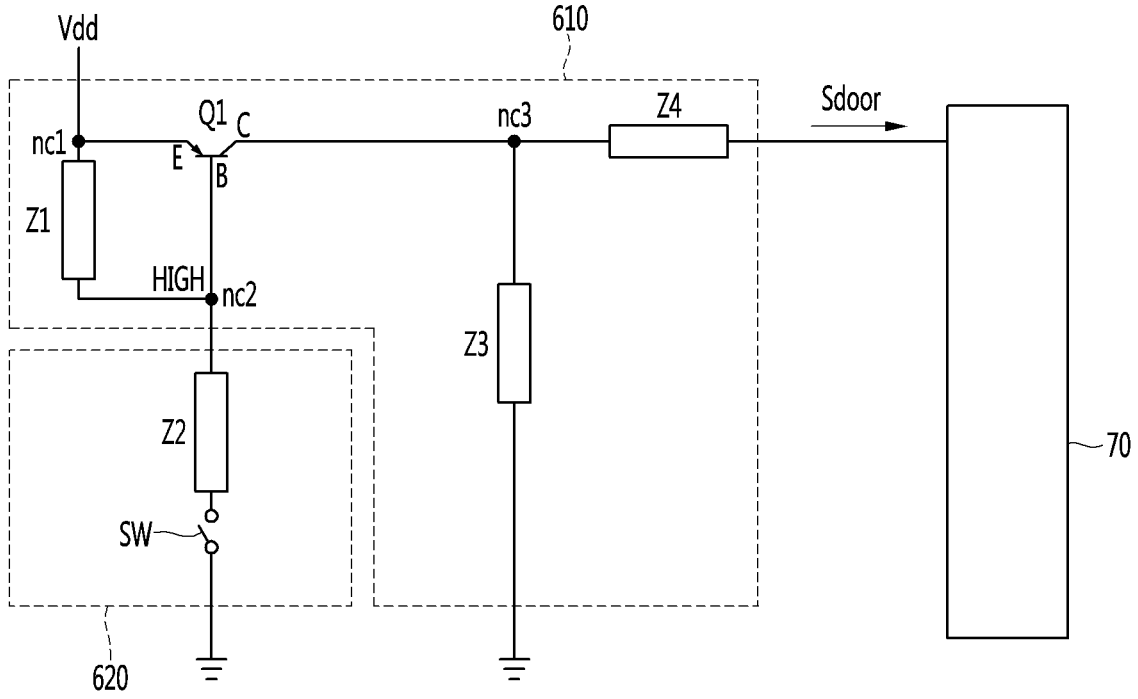
FIG. 10 is a circuit configuration diagram of a first exemplary circuit for a control circuit of a door opening detection unit according to the second embodiment.

FIG. 10 is a first exemplary circuit configuration diagram of a control circuit of the door opening detection unit according to the second embodiment.

Referring to FIG. 10, the control circuit 600 may include the open signal generation circuit 610 and the switch circuit 620.

The open signal generation circuit 610 may include a first transistor Q1, a first impedance Z1, a second impedance Z2, a third impedance Z3, and a fourth impedance Z4.

The switch circuit 620 may include the second impedance Z2 and the switch SW. The switch SW may be opened or closed based on a signal generated by the door opening detection unit 500. For example, the door opening detection unit 500 may detect that the cassette door 22 is opened. At this time, the door opening detection unit 500 may generate an open signal Sopen to close the switch SW. Conversely, the door opening detection unit 500 may detect that the cassette door 22 is closed. At this time, the door opening detection unit 500 may open the switch SW by generating a closing signal.

In summary, the control circuit 600 may transmit an open detection signal Sdoor for the cassette door 22 to the microcomputer 70 based on a signal generated by the door opening detection unit 500.

The open signal generation circuit 610 may include a first transistor Q1 connected to the switch circuit 620 and transmitting an open detection signal Sdoor to the microcomputer 70.

The first transistor Q1 may include an emitter terminal E, a base terminal B, and a collector terminal C. And, the first transistor Q1 may be a PNP type transistor which is turned on when the base terminal B of the first transistor Q1 has a lower voltage than the emitter terminal E.

A driving voltage Vdd may be supplied to the emitter terminal E of the first transistor Q1. As described above, the driving voltage Vdd may be applied from the financial device 1 or the battery 320.

The base terminal (B) of the first transistor (Q1) may be connected to the low voltage line. The low voltage line may mean a line that has a lower voltage than the driving voltage Vdd. The low voltage line may be a ground line, but may be a bus line having a voltage lower than the driving voltage Vdd in some cases.

When the base terminal B of the first transistor Q1 is connected to the low voltage line, the first transistor Q1 may be turned on.

The switch SW may be disposed between the base terminal B of the first transistor Q1 and the low voltage line. And the switch SW may control the connection between the base terminal B of the first transistor Q1 and the low voltage line. Specifically, when the cassette door 22 is closed, the switch SW may be closed by the door opening detection unit 500. Accordingly, the connection between the base terminal B of the first transistor Q1 and the low voltage line may be released. Conversely, when the cassette door 22 is opened, the switch SW may be opened by the door opening detection unit 500. Accordingly, the base terminal B of the first transistor Q1 and the low voltage line may be connected.

In summary, according to the operation of the switch SW, when the cassette door 22 is opened, the first transistor Q1 is turned on. Conversely, when the cassette door 22 is closed, the first transistor Q1 is turned off.

The voltage formed at each node of the control circuit 600 based on each state of the switch SW will be described with reference to FIGS. 11 and 12.

Hereinafter, for convenience of explanation, the emitter terminal E of the first transistor Q1 is referred to as a control circuit first node nc1. The base terminal B of the first transistor Q1 is referred to as a control circuit second node nc2. The collector terminal C of the first transistor Q1 is referred to as a control circuit third node nc3.

Figure 11:
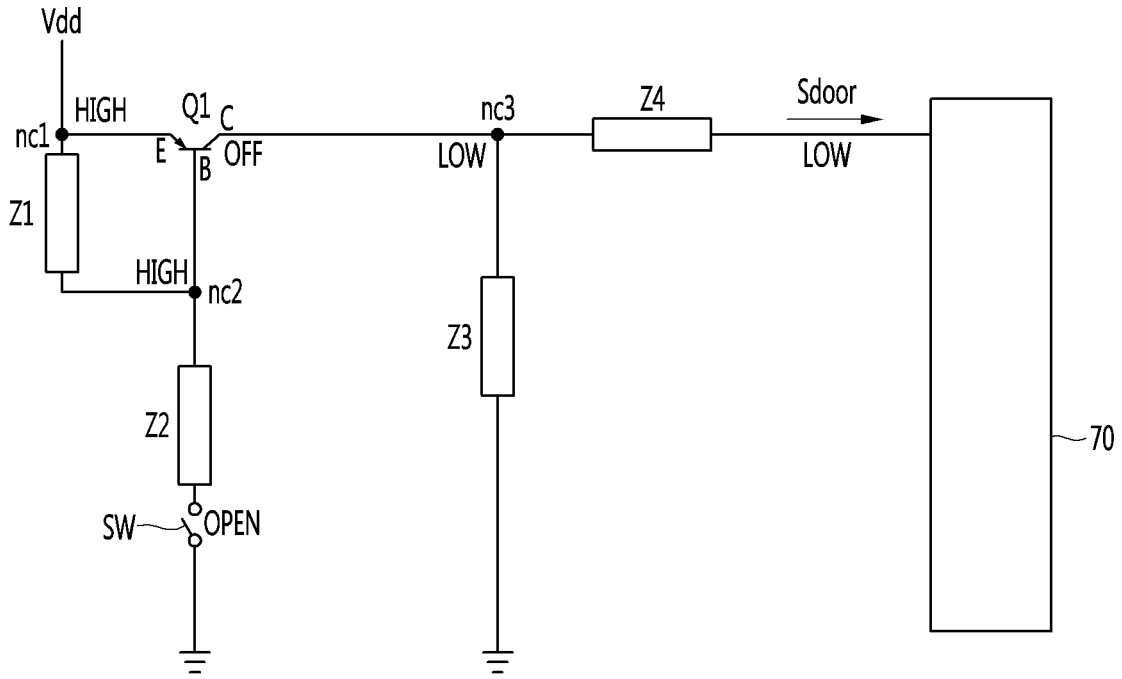
FIG. 11 is a circuit diagram illustrating a voltage state of each node when a switch is opened in FIG. 10.

FIG. 11 is a circuit diagram illustrating a voltage state of each node when the switch is opened in FIG. 10. FIG. 12 is a circuit diagram illustrating a voltage state of each node when the switch is closed in FIG. 10.

First, referring to FIG. 11, the switch SW may be opened according to the closing of the cassette door 22. Thus, the connection between the control circuit second node nc2 and the low voltage line may be released.

The control circuit first node nc1 and the control circuit second node nc2 may be connected through the first impedance Z1. Thus, when the connection between the control circuit second node nc2 and the low voltage line is released, the voltage of the control circuit first node nc1 may be directly transmitted to the second node nc2 through the first impedance Z1.

The control circuit first node nc1 may have a logic high voltage by the driving voltage Vdd. The voltage of the control circuit first node nc1 may be transferred as it is to the control circuit second node nc2 according to the opening of the switch SW. Accordingly, the control circuit second node nc2 may have a logic high voltage. Therefore, when a logic high voltage is applied to the base terminal B of the first transistor Q1, the first transistor Q1 may be turned off.

The control circuit third node nc3 and the low voltage line may be connected to the third impedance Z3. When the first transistor Q1 fails to transfer the voltage to the control circuit third node nc3 according to the turn-off of the first transistor Q1, the control circuit third node nc3 may have a logic low voltage by the low voltage line. The output of the control circuit third node nc3 may be transmitted to the microcomputer 70. That is, when the cassette door 22 is closed, the microcomputer 70 receives the logic low voltage as an open detection signal Sdoor.

Figure 12:
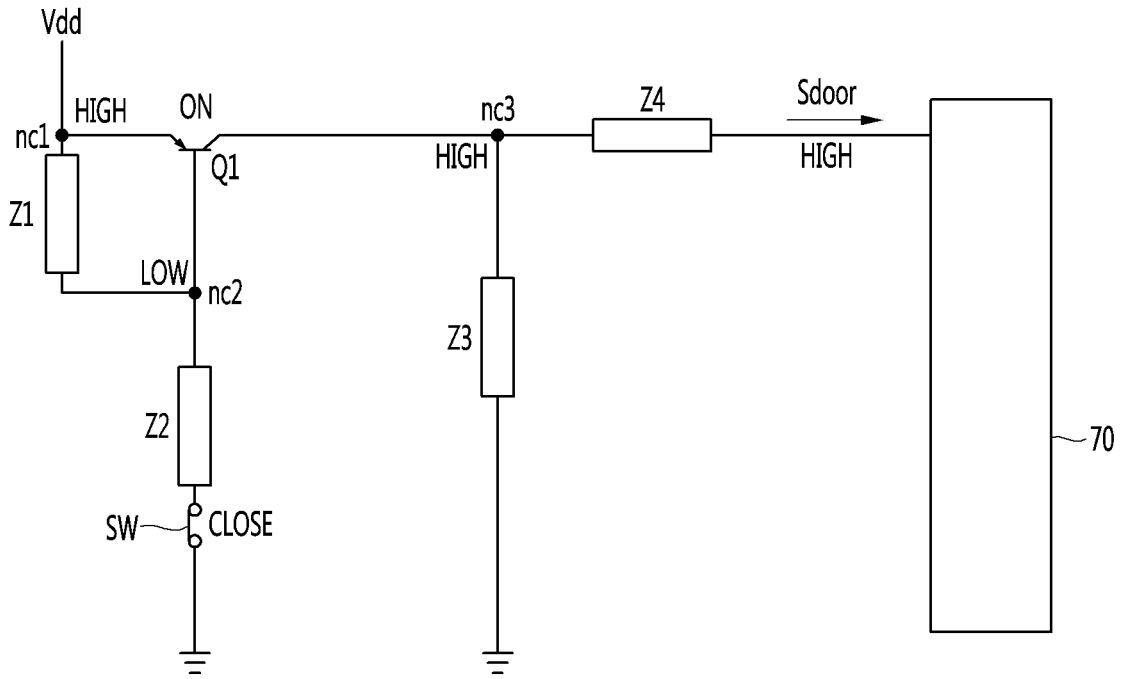
FIG. 12 is a circuit diagram illustrating a voltage state of each node when the switch is closed in FIG. 10.

Meanwhile, referring to FIG. 12, the switch SW may be closed by opening the cassette door 22. Accordingly, the control circuit second node nc2 and the low voltage line may be connected.

When the control circuit second node nc2 and the low voltage line are connected, the base terminal B of the first transistor Q1 has a logic low voltage.

Meanwhile, a second impedance Z2 may be disposed between the control circuit second node nc2 and the switch SW. Alternatively, the second impedance Z2 may be disposed between the switch SW and the low voltage line. By the second impedance Z2, an excessive current flow between the control circuit second node nc2 and the low voltage line may be reduced. In addition, an excessive voltage difference between the emitter terminal E and the base terminal B of the first transistor Q1 may be prevented.

When the logic low voltage of the base terminal B of the first transistor Q1 is applied, the first transistor Q1 may be turned on. Therefore, a logic high voltage is formed in the control circuit third node nc3. Moreover, the microcomputer 70 may receive the logic high voltage as an open detection signal Sdoor. At this time, the open detection signal Sdoor of the logic high voltage may mean the open signal Sopen.

Meanwhile, in order to prevent an excessive current or voltage from being supplied from the control circuit third node nc3 to the microcomputer 70, a fourth impedance Z4 may be further disposed between a control circuit fourth node nc4 and the microcomputer 70.

As shown in FIGS. 10 to 12, when the cassette door 22 is closed, the first transistor Q1 of the control circuit 600 is turned off, so that power (signal) is not transmitted to the microcomputer 70. That is, only when the cassette door 22 is opened from the cassette body 21, the first transistor Q1 may be turned on to consume electric power. Therefore, there is an advantage that the power consumed by the financial device 1 or the battery 320 connected to the medium storage box 20 may be reduced.

Figure 13:
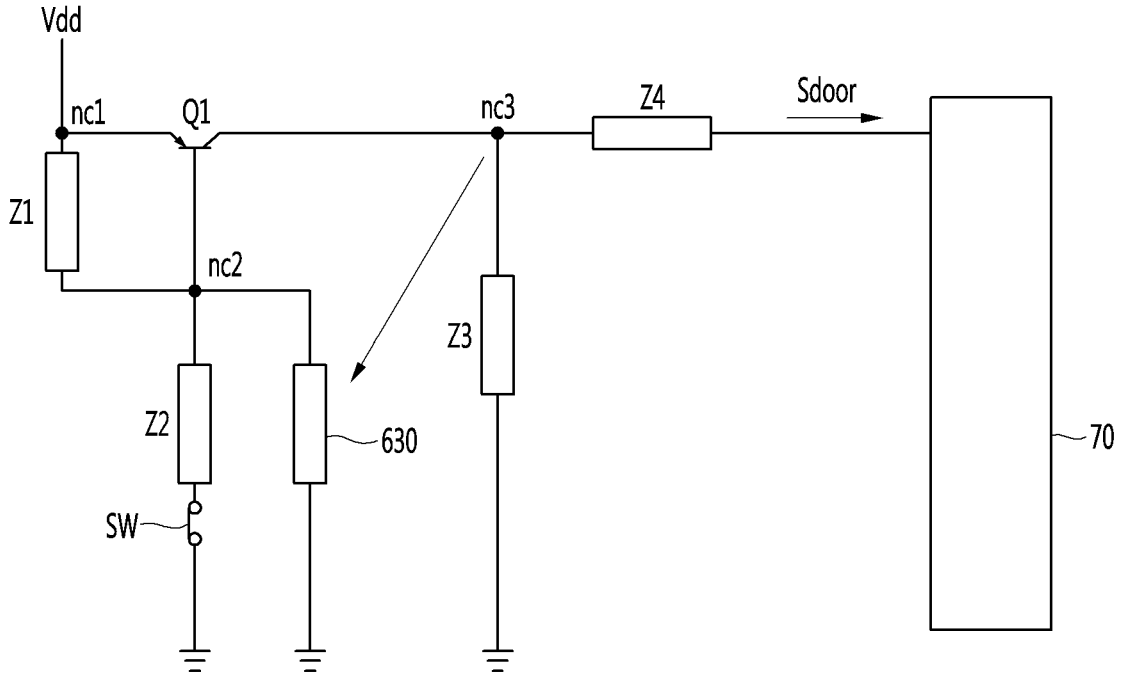
FIG. 13 is a circuit configuration diagram in which a signal holding circuit is added to FIG. 10.

FIG. 13 is a circuit diagram in which a signal holding circuit is added to FIG. 10.

Referring to FIG. 13, the control circuit 600 may further include a signal holding circuit 430 for continuously transmitting the open signal Sopen to the microcomputer 70. The signal holding circuit 430 may be connected in parallel with the switch circuit 620. In detail, one side of the signal holding circuit 430 may be connected to the low voltage line. Moreover, the other side of the signal holding circuit 430 may be connected to the control circuit second node nc2. When the cassette door 22 is opened from the cassette body 21, the voltage of the control circuit second node nc2 may be changed to a set voltage (for example, a low voltage). At this time, the signal holding circuit 430 may maintain the voltage of the control circuit second node nc2 which is formed between the switch circuit 620 and the open signal generation circuit 610 when the cassette door 22 is opened. Unless a separate command is input from the microcomputer 70, the voltage of the control circuit second node nc2 can be maintained so that the open signal Sopen is continuously generated. Accordingly, even when the cassette door 22 is closed without a separate command of the microcomputer 70, the open signal Sopen may be prevented from being released.

The signal holding circuit 430 may control the voltage of the base terminal B of the first transistor Q1 by using the voltage of the control circuit third node nc3. Accordingly, the voltage state of the open detection signal Sdoor may be kept constant.

For example, the cassette door 22 may be opened from the cassette body 21. At this time, the logic high voltage of the control circuit third node nc3 may be transmitted to the microcomputer 70 as an open detection signal Sdoor. Moreover, the signal holding circuit 430 may receive the logic high voltage of the control circuit third node nc3 to continuously maintain the turn-on state of the first transistor Q1.

Figure 14:
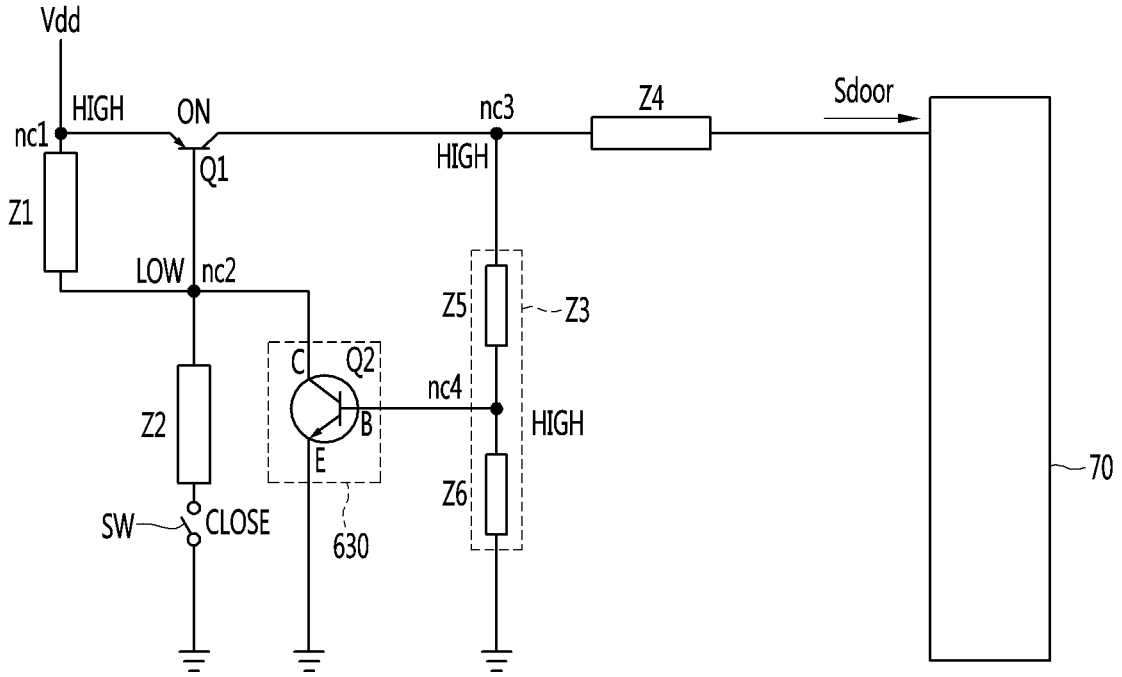
FIG. 14 is a circuit diagram illustrating a detailed configuration of FIG. 13 and a voltage state of each node when the switch is closed.

FIG. 14 is a circuit diagram illustrating a detailed configuration of FIG. 13 and the state of the voltage of each node when the switch is closed.

Referring to FIG. 14, the signal holding circuit 430 may include a second transistor Q2. Moreover, the second transistor Q2 may include a collector terminal C, an emitter terminal E, and a base terminal B. The collector terminal C of the second transistor Q2 may be connected to the control circuit second node nc2. Moreover, the emitter terminal E of the second transistor Q2 may be connected to the low voltage line. The base terminal B of the second transistor Q2 may be interlocked with the voltage of the control circuit third node nc3.

Specifically, the control circuit third node nc3 and the third impedance Z3 connecting the low voltage line may be composed of two impedances Z5 and Z6. And the base terminal B of the second transistor Q2 may be connected to the control circuit fourth node nc4 where the fifth impedance Z5 and the sixth impedance Z6 meet.

When the control circuit third node nc3 indicates a logic high voltage, the control circuit fourth node nc4 may have a logic high voltage according to voltage distribution of the fifth impedance Z5 and the sixth impedance Z6. When the control circuit fourth node nc4 indicates a logic high voltage, the second transistor Q2 is turned on so that the control circuit second node nc2 and the low voltage line may be connected. Therefore, when the control circuit second node nc2 and the low voltage line are connected, the first transistor Q1 may be kept turned on even if the switch SW is opened.

At this time, the second transistor Q2 and the switch SW are connected in parallel to each other between the second node nc2 and the low voltage line. Therefore, even if the switch SW is opened, the second transistor Q2 may connect the base terminal B of the first transistor Q1 and the low voltage line.

In FIGS. 13 and 14, one side of the second transistor Q2 is shown connected to the control circuit second node nc2. However, depending on an embodiment, one side of the second transistor Q2 may be connected to a contact node between the second impedance Z2 and the switch SW. The second transistor Q2 may be, as an example, an npn type transistor.

Figure 15:
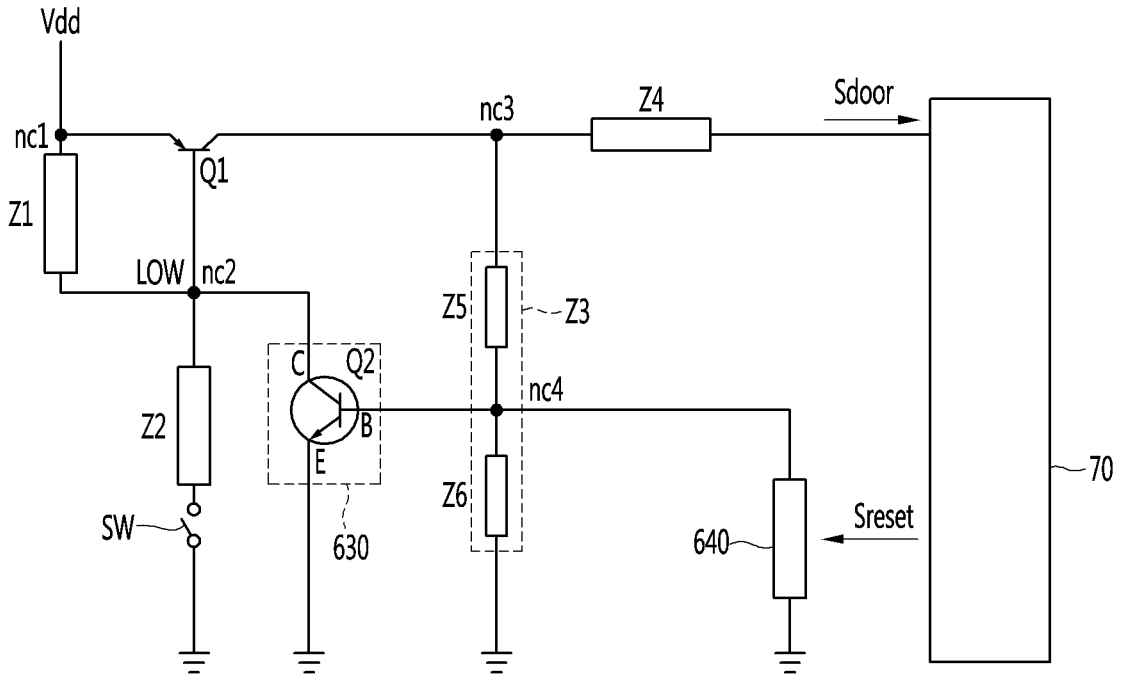
FIG. 15 is a circuit configuration diagram in which a reset circuit is added to FIG. 13.

FIG. 15 is a circuit configuration diagram in which a reset circuit is further added in FIG. 13.

Referring to FIG. 13, the control circuit 600 may further include a reset circuit 640 for resetting the signal holding circuit 430. When the microcomputer 70 generates a reset signal Sreset, the reset circuit 640 may reset the signal holding circuit 430. When the signal holding circuit 430 is reset, the open signal Sopen is no longer maintained. However, if the cassette door 22 is kept open from the cassette body 21, even if the signal holding circuit 430 is reset, the open signal Sopen may still be generated by the switch circuit 620.

The reset circuit 640 controls the connection of the base terminal B of the second transistor Q2 and the low voltage line, so that the open detection signal Sdoor may be reset by the second transistor Q2.

One side of the reset circuit 640 may be connected to the base terminal B of the second transistor Q2. Moreover, the other side of the reset circuit 640 may be connected to the low voltage line. The reset circuit 640 may determine whether to connect the base terminal B of the second transistor Q2 and the low voltage line based on the reset signal Sreset received from the microcomputer 70.

Figure 16:
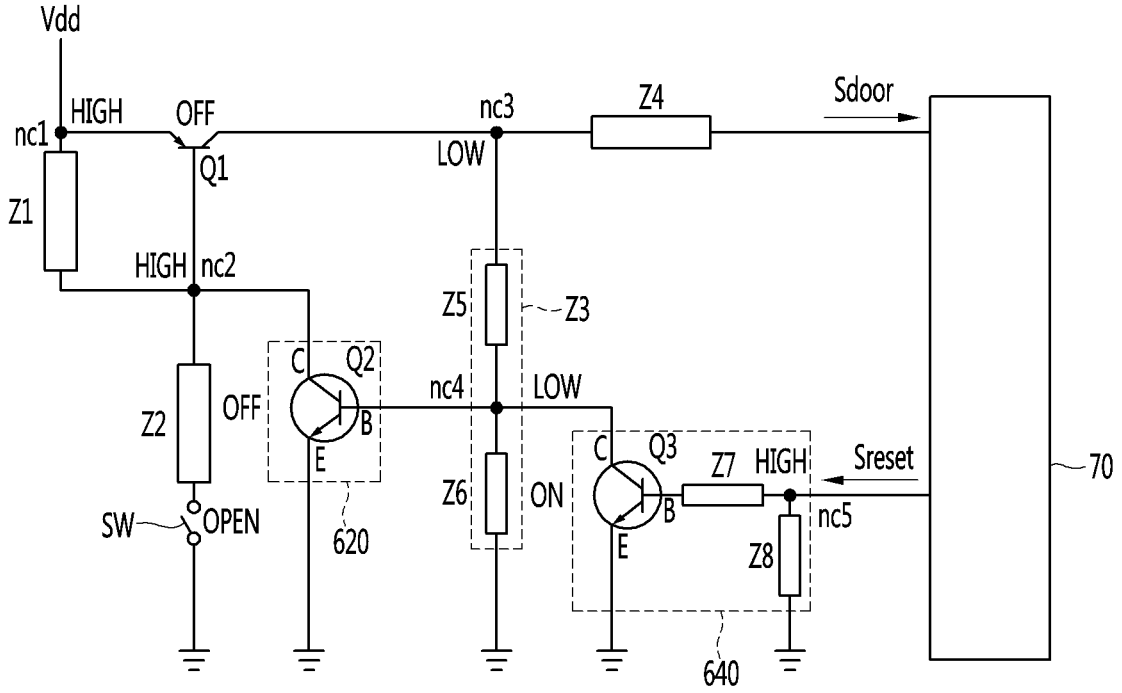
FIG. 16 is a circuit diagram illustrating a detailed configuration of FIG. 15 and a voltage state of each node when the switch is opened in FIG. 15.

FIG. 16 is a circuit diagram illustrating a detailed configuration of FIG. 15 and a voltage state of each node when the switch is opened.

Referring to FIG. 16, the reset circuit 640 may include a third transistor Q3. The third transistor Q3 may include a collector terminal C, an emitter terminal E, and a base terminal B. Moreover, the collector terminal C of the third transistor Q3 may be connected to the base terminal B of the second transistor Q2. In other words, the collector terminal C of the third transistor Q3 may be connected to the control circuit fourth node nc4.

The reset signal Sreset may be input to the base terminal B of the third transistor Q3. A seventh impedance Z7 and an eighth impedance Z8 may be placed between the base terminal B of the third transistor Q3 and the low voltage line. And the reset signal Sreset may be input from the microcomputer 70 to a control circuit fifth node nc5, which is a contact node where the seventh impedance Z7 and the eighth impedance Z8 meet.

When the voltage of the reset signal Sreset indicates a logic high, the third transistor Q3 may be turned on. At this time, the control circuit fourth node nc4 and the low voltage line may be connected to each other. Therefore, the control circuit fourth node nc4 may represent a logic low voltage (LOW). Moreover, the second transistor Q2 may be turned off.

When the second transistor Q2 is turned off, the control circuit second node nc2 may become logic high. Accordingly, the first transistor Q1 may be turned off.

In summary, a logic low voltage is transferred to the control circuit third node nc3 according to the turn-off of the first transistor Q1. Moreover, a logic low voltage may be transmitted to the microcomputer 70 as an open detection signal Sdoor.

Meanwhile, when the medium storage box 20 is unmounted from the financial device 1, the power of the battery 320 may be supplied to the power output unit 252 by the power source selection unit 330. At this time, the door opening detection unit 500 may be reset by the reset circuit 640. In other words, the door opening detection unit 500 may be initialized by the reset circuit 640. Therefore, the door opening detection unit 500 may not be operated until the cassette door 22 is opened from the cassette body 21.

Therefore, the power consumed by the battery 320 may be reduced even if the medium storage box 20 is not opened or opened during movement.

In the embodiment, the switch SW of the switch circuit 620 has been described to be turned on or off by the door opening detection unit 500. However, in another embodiment, the door opening detection unit 500 may be the switch SW. For example, the door opening detection unit 500 may be a microswitch. In addition, the door opening detection unit 500 may be installed at a position where the cassette door 22 and the cassette body 21 are in contact with each other. When the cassette door 22 is opened, the door opening detection unit 500 may be closed (or turned on). When the door opening detection unit 500 is closed, the switch circuit 620 can be turned on. Conversely, when the cassette door 22 is closed, the door opening detection unit 500 may be opened (or turned off). When the door opening detection unit 500 is opened, the switch circuit 620 may be turned off.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or includes or has) some elements, it should be understood that it may comprise (or include or has) only those elements, or it may comprise (or include or have) other elements as well as those elements if there is no specific limitation. Unless otherwise specifically defined herein, all terms including technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. A medium storage box, comprising:

a cassette body having a storage space in which a medium is stored;

a cassette door coupled to the cassette body to open or close the storage space;

a door opening detection unit that is configured to generate an open detection signal when the cassette door is opened;

a microcomputer that is configured to determine that the cassette door is opened when the open detection signal is received, and for storing the determined opening information of the cassette door in a cassette memory;

a battery that is configured to supply power to the door opening detection unit and the microcomputer; and a transistor disposed between the door opening detection unit and the battery, wherein the transistor is turned on by receiving the open detection signal of the door opening detection unit, and the power of the battery is supplied to the microcomputer when the transistor is turned on, and wherein the transistor is turned off and the power supply of the battery input to the microcomputer is cut off when the input of the open detection signal of the door opening detection unit is cut off.

2. The medium storage box of claim 1, wherein the microcomputer stores the opening information of the cassette door in the cassette memory when power is supplied from the battery.

3. The medium storage box of claim 1, further comprising:

a first detection unit for detecting that the medium storage box is mounted on a financial device; and a power input unit connected to a power source of the financial device, wherein the power supplied from the battery is cut off when it is detected that the medium storage box is mounted on the financial device, and power is supplied from the financial device through the power input unit.

4. The medium storage box of claim 3, further comprising a power source selection unit for supplying power to the microcomputer by selecting either one of the power supplied by the power input unit or the battery.

5. The medium storage box of claim 4, wherein, the power source selection unit supplies power having a higher voltage between a voltage of the power supplied from the power input unit or a voltage of the battery to the microcomputer.

6. The medium storage box of claim 3, wherein the battery is charged by the power supplied from the power input unit when the power input unit is connected to the power source of the financial device.

7. The medium storage box of claim 3, wherein the microcomputer transfers information stored in the cassette memory to the financial device when the first detection unit detects that the medium storage box is mounted on the financial device.

8. The medium storage box of claim 1, further comprising:

a switch circuit that is turned on based on the open detection signal generated by the door opening detection unit; and an open signal generation circuit for generating an open signal by the ON operation of the switch circuit, wherein the open signal is transmitted to the microcomputer.

9. The medium storage box of claim 8, wherein the microcomputer determines that the cassette door is opened based on the open signal.

10. The medium storage box of claim 8, further comprising: a signal holding circuit which is connected in parallel to the switch circuit and which receives the open signal and holds the open signal generated by the open signal generation circuit; and a reset circuit for resetting the signal holding circuit.

11. The medium storage box of claim 10, wherein the reset circuit resets the signal holding circuit when the door opening detection unit detects that the cassette door is closed.

12. The medium storage box of claim 10, further comprising a first detection unit for detecting that the medium storage box is mounted on a financial device, wherein the reset circuit resets the signal holding circuit when detected that the first detection unit is mounted on the financial device.

13. The medium storage box of claim 1, further comprising an open signal generation circuit for generating an open signal by the ON operation of the door opening detection unit, wherein the open signal is transmitted to the microcomputer.

14. The medium storage box of claim 1, further comprising at least one of:

a door opening counter for counting the number of door openings detected by the door opening detection unit; and a timer for counting a door opening time period detected by the door opening detection unit.

* * * * *